US005791575A

United States Patent [19]

Badiali et al.

[11] Patent Number: 5,791,575

[45] Date of Patent: Aug. 11, 1998

[54] SYSTEM FOR HANDLING AND DISTRIBUTING SPOOLS FOR AN AUTOMATIC CONING MACHINE

[75] Inventors: Roberto Badiali, Pordenone; Luciano Bertoli, Fiume Veneto; Giorgio Colomberotto, Sacile, all of Italy

[73] Assignee: Savio Macchine Tessili S.p.A., Pordenone, Italy

[21] Appl. No.: 583,436

[22] Filed: Jan. 5, 1996

[30] Foreign Application Priority Data

Jan. 10, 1995 [IT] Italy ..... MI 95/A/000025

[51] Int. Cl.[6] ..... B65H 54/02; D01H 9/10; B65G 19/26

[52] U.S. Cl. ..... 242/35.5 A; 57/281; 198/732

[58] Field of Search ..... 242/35.5 A, 35.5 R; 57/281; 198/732

[56] References Cited

U.S. PATENT DOCUMENTS

| | | | |
|---|---|---|---|
| 4,463,909 | 8/1984 | Kiriake et al. | 242/35.5 A |
| 4,544,107 | 10/1985 | Matsui et al. . | |
| 4,571,931 | 2/1986 | Kupper | 57/281 |
| 4,597,540 | 7/1986 | Kiriake | 242/35.5 A |
| 4,781,334 | 11/1988 | Derichs | 242/35.5 A |
| 4,856,723 | 8/1989 | Tone | 242/35.5 R |
| 4,964,269 | 10/1990 | Dinkelmann | 242/35.5 A X |
| 5,159,805 | 11/1992 | Wernli | 242/35.5 A X |
| 5,175,990 | 1/1993 | Fritschi et al. | 242/35.5 A X |
| 5,185,993 | 2/1993 | Fritschi et al. | 57/281 |
| 5,289,674 | 3/1994 | Baldiali et al. | 57/281 |
| 5,443,217 | 8/1995 | Nishikawa et al. | 242/35.5 A |

FOREIGN PATENT DOCUMENTS

| | | | |
|---|---|---|---|
| 41 29 537 | 3/1993 | Germany | 57/281 |
| 49-12128 | 3/1974 | Japan . | |
| 648009 | 6/1994 | Switzerland . | |
| 1170660 | 5/1968 | United Kingdom . | |

*Primary Examiner*—Michael Mansen
*Attorney, Agent, or Firm*—George P. Hoare; Rogers & Wells

[57] ABSTRACT

A conveyor system for an automatic coning machine having coning units for unwinding thread from spools carried by disks. The system has a feeding conveyor for transporting the spools on carrying disks to the coning machine and a removal conveyor for transporting exhausted spool carrying disks from the coning machine. Passages traverse adjacent coning units which are interconnected to and between the conveying and removal conveyors. Feeders are provided for, at least, the feeding conveyor. The feeders are connected to and movable with the feeding conveyor, wherein the feeders are spaced apart from one another and wherein each of said feeders includes an engaging member for contacting a spool carrying disk and moving the spool carrying disk along the feeding conveyor, and a jutting member movably connected to the feeder which contacts the engaged spool carrier disk for guiding the spool carrier disk in a desired position along the conveyor. The system also has a movable deflector operatively connected to each coning unit and its adjacent passage. The deflector is movable into the path of a spool carrying disk being fed along the feeding conveyor by the feeders for engaging and deflecting the movement of a spool carrying disk from a feeder when a spool carrying disk is required in the adjacent passage. Concurrently the deflector is movable out of the path of the feeder.

12 Claims, 5 Drawing Sheets

SYSTEM FOR HANDLING AND DISTRIBUTING SPOOLS FOR AN AUTOMATIC CONING MACHINE

FIELD OF INVENTION

This invention relates to an automatic conveyor system for providing spools on carrier disks to an automatic coining machine having one or more coning stations, for handling the spools on the carrier disks from a stand-by position, to an unwinding position and to a discharge position in a coning station, and for removing the spools on the carrier disks from the coning machine.

BACKGROUND TO THE INVENTION

High quality thread can be manufactured by spinning and coning. In the first step, the thread is produced and in the second step the thread is coned or rewound to remove faulty or irregular thread and to thereby provide a high-quality product.

The coning, or rewinding, step generally is carried out at much higher speeds than the spinning step; thus, a small number of coning stations can process the thread produced by a much larger number of spinning stations. The thread is produced and wound on a large number of spools of relatively small size and the produced thread is unwound and rewound into a smaller number of cones having a much larger size than the spools.

The difference in productivity between the described steps is so large that the same coning machine can be used to simultaneously process thread produced by a plurality of spinning frames, and even different types of thread produced by different spinning frames.

The available processing capacity of the coning step is generally installed with a meaningful capacity in excess to the spinning step, so that the coning machine may process the product from the spinning frame, without the risk of being overloaded.

The handling requirements do not relate only to the spools filled with wound thread (i.e., the cop) and the empty tubes, but also to a small, but meaningful, number of irregular spools, i.e., tubes from which the thread was not completely unwound, but for which the coning station is no longer capable of recovering additional thread because a thread end cannot be recovered with the means at the coning station. The irregular spools are discharged and recycled to the spool preparation devices for thread end location and are then fed again to the coning machine, in order to exhaust the thread still wound on the tube. The spools from which a thread end is not recoverable are discharged and submitted to separate treatments.

For the coning operation, it is necessary that the spools produced by the spinning step are prearranged with their thread ends at a predetermined position, in general with a thread end slid through the upper opening of the tube on which the thread is wound to form the cop. The automatic coning unit will thus be capable of automatically catching the thread end from each spool as they are fed to the unit, and of starting the coning thereof, for the production of the cones.

Between the spinning frame and the coning machine, rather large amounts of materials have to be handled: the empty tubes returned to the spinning frame, on which new cops are wound, and the filled spools produced by the spinning frame are prepared and fed to the coning machine. For indicative purposes, in the coning machines designed according to the most recent concepts, each coning station is capable of processing thirty, or even more, spools per hour, so that the total number of spools to be handled can be as large as some thousand pieces per hour. The handling volume requirement is very burdensome and in the most modern facilities it is committed, as far as possible, to automatic devices, with the intervention by the attending operators being reserved to supervision and addressing malfunctions.

In the traditional coning machines, the handling of spools and tubes was carried out by means of box trolleys from which the spools or tubes were taken either by means of charging and ordering devices, or more simply, by hand. In more recent models, the transfer of the spools is carried out by means of conveyor belts, e.g. according to U.S. Pat. No. 4,571,931 to Schlafhorst, on which the ready spools are charged and released towards the coning stations. In U.S. Pat. No. 5,289,674 to Savio, the transfer of the ready spools to the coning units is committed to a device with running pockets always kept full and circulating, so as to create a reserve, or magazine, of ready spools.

A different technical solution consists in transferring the spools onto supporting carrier means provided with a central vertical pin and keeping the spools on the carrier means during the unwinding step, e.g., Japanese patent JP-A-49-12128 to Kanebo, or German patents 3,235,442; 3,213,253; and 3,249,583 to Murata. The adoption of the described carrier means makes it possible to transfer and process the spools practically without touching them and by only acting on the carrier means, generally having a disk shape (e.g., a plate of circular shape). The spool can be identified by instrumental means, when a plurality of thread batches are processed simultaneously, from the supporting carrier disk means.

According to the prior art, the handling of the spool carrier disk means is generally carried out by moving the surface on which they rest, e.g., with conveyor belts in the case of rectilinear motions and revolutionary disks for circular motions. The advantages for the processed spools are achieved at the cost of some drawbacks, such as considerable complexities as relates to the conveying component. During the coning step, a large amount of dirt is developed from dust and short fibers released by the threads, which can cause blockage or malfunctioning of the conveying components. The fact that the carrier disk means simply rests on the conveyor belt implies the risk that irregularities may cause the carrier disk means to overturn and the spools to fall down.

SUMMARY OF THE INVENTION

The present invention relates to apparatus for feeding the spools on carrier disks to an automatic coning machine and handling them at the coning stations by using the carrier disks, as regards both the handling of spools to be delivered to the coning stations, and the handling of the spools at the coning stations to move them between their stand-by, cop unwinding and exhausted spool tube discharging positions.

The present invention provides an improved system for transferring and handling the spools and tubes supported on spool carrier disk means, free from the drawbacks displayed by analogous prior art devices and processes.

DESCRIPTION OF THE DRAWINGS

The characteristics and advantages of the system for feeding and handling the spools and tubes on a coning machine according to the present invention will be evident from the disclosure of the illustrative embodiments shown in FIGS. 1–5, in which:

FIG. 1A is a front view of FIG. 1, taken along the lines 1A—1A thereof, and illustrates the conveying of carrier disks conveying full and empty spools;

FIG. 3B is a plan view of another embodiment of the feeding components;

DESCRIPTION OF THE PREFERRED EMBODIMENTS

Figure 1:
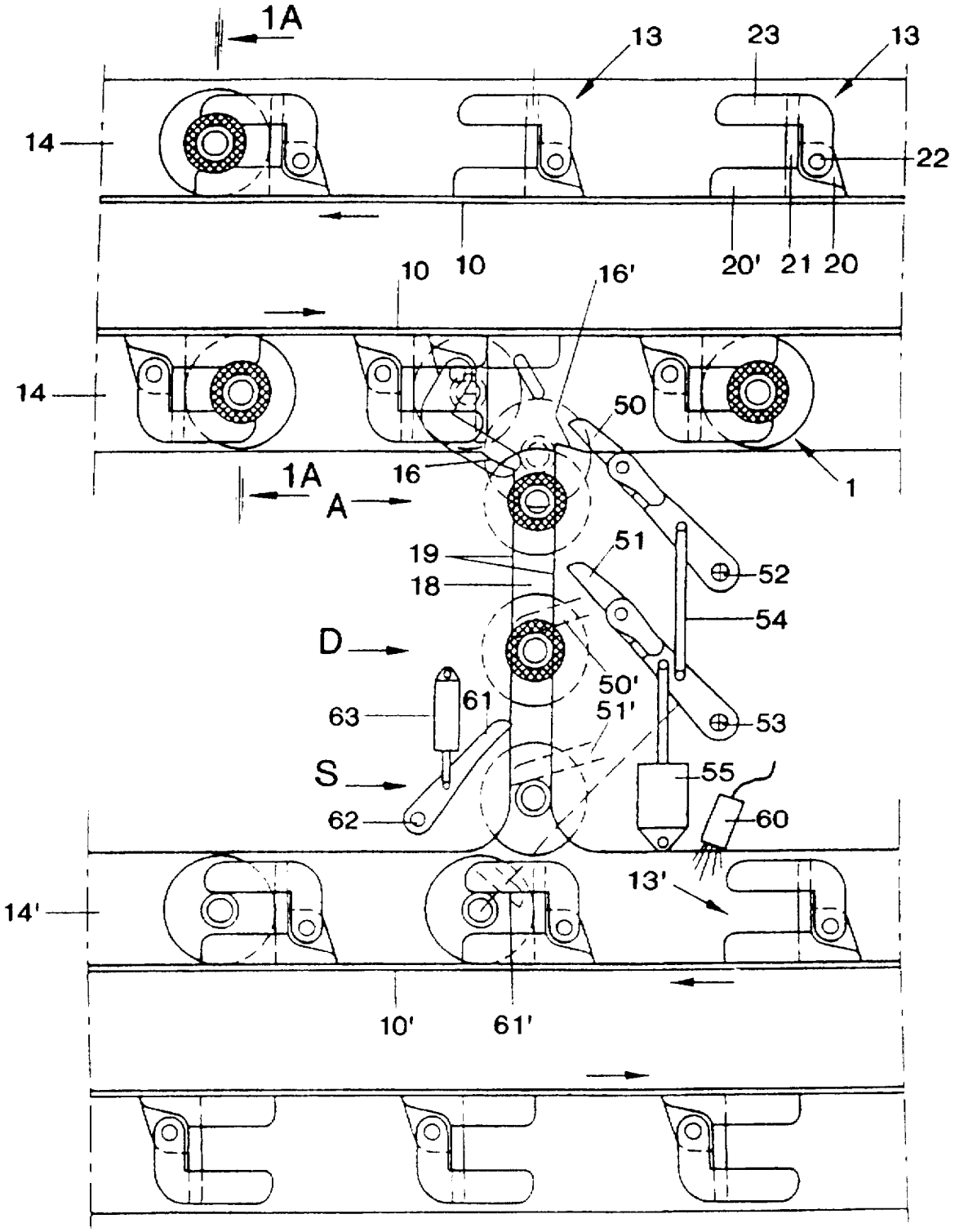
FIG. 1 is a plan view of a conveyor system of the present invention at a coning unit of the coning machine, wherein full spools on carrier disks are traveling in one direction and empty tubes on the carrier disks are travelling in the other direction to and from the coning machine.

The spool carrier disk (1), as shown in the detail of FIG. 1A, per se known, has a circular base (2), and a spool supporting pin having a collar (3), on which the tube of the spool to be conveyed rests, and a pin (4) which engages the bottom opening of the tube (5) of the spool. The diameter of the collar (3) is substantially larger than that of the tube, and the diameter of the pin (4) is slightly smaller than the diameter of the bore of the tube (5), so as to constrain the tube to stand in the vertical position on the pin (4). According to the present invention, the carrier disks destined to support the spools for transport are made from materials, and with a finish degree of their bottom bases, as to insure that each bottom base will display low adhesion to the flat surfaces onto which it comes to rest, so that it can be caused to slide on said surfaces by means of a very small applied force.

At the beginning of the conveyance operation, the spool to be unwound is positioned on a spool carrier disk by means of per se known devices and methods.

According to the present invention, on the rear side of the coning machine, a handling system is installed for handling the full spools to be fed to the coning stations which constitute the automatic coning machine.

The system has a drive means (10), which can be a belt or a chain, and is caused to run according to a horizontal closed path, i.e., loop, between two vertical-axis guide/drive means (11). When the drive means (10) is a smooth or toothed belt, its drive means (11) can be normal pulleys. On the other hand, when the drive means (10) is a toothed belt or a chain, its guide means (11) can be sprockets. The guide means (11) is provided with a drive motor (12), e.g., an electrical motor with a suitable reduction gear means.

To the drive means (10) , which runs in a direction as shown by the directional black arrows, pushing/guide means (13) are fastened and arranged at the level of the bases (2) of the spool carrier disks (1) and push the carrier disks (1) in the direction of the arrows.

The pushing/guide means (13) constitute one of the characteristic features of the present invention, and now will be disclosed by referring to the embodiment illustrated at the top of FIG. 1. The means (13) has a base (20) rigidly constrained to the belt (10) from which a bracket (21) extends perpendicularly to said belt (10). The bracket (21) engages the base (2) of the spool carrier disk (1) to apply a push to it, as schematically indicated in FIG. 1. The fixed base (20) is so shaped as to extend, with an extending or jutting portion or member (20') thereof, over a meaningful portion of the base (2) of the spool disk carrier means (1), on its side facing the belt (10). On the base (20), by means of a vertical pivot (22) a horizontal jutting member (23) is hinged and extends over a meaningful portion of the base of the spool carrier disk (1) on the side relatively opposite to the belt (10). The jutting member (23) extends forward in order to prevent the collar (3) of the spool carrier disk (1) from undergoing transversal shifts. The jutting member (13) can be opened outwards with a moderate force, as necessary in order to override the resistance of a return spring (not shown in Figure), to enable the spool carrier disk (1) to become disengaged from its transport means on the occasion of its commanded diversion towards a coning station.

According to a preferred embodiment of the invention, the opening of the guide fork formed by the juttings (20') and (23) is just larger than the diameter of the collar (3) of the spool carrier disk (1). When the spool carrier disk is disengaged, the spring causes the jutting (23) to return back to its "closed" position.

Figure 2A:
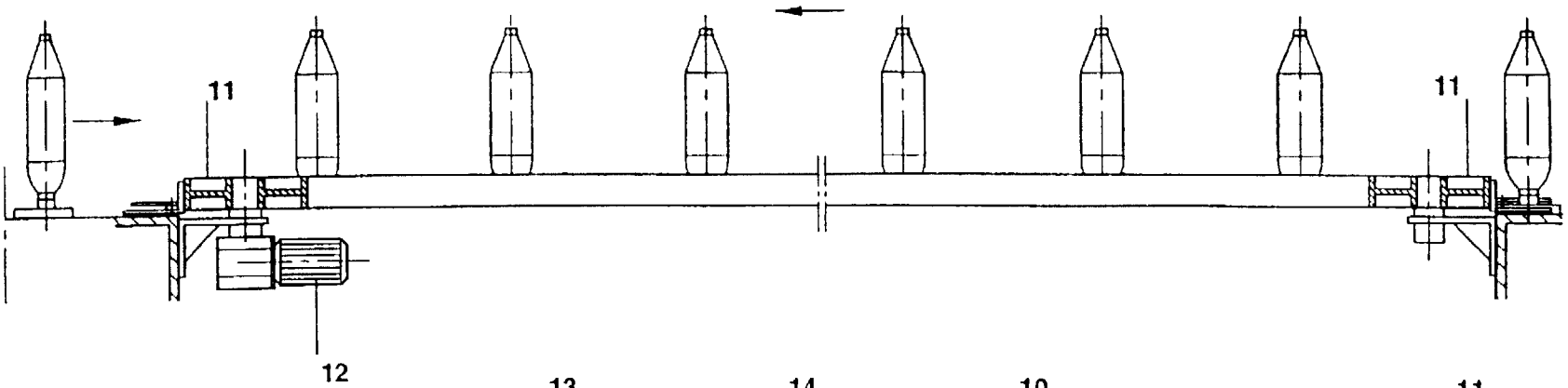
FIG. 2A is a side view of FIG. 2.
Figure 2:
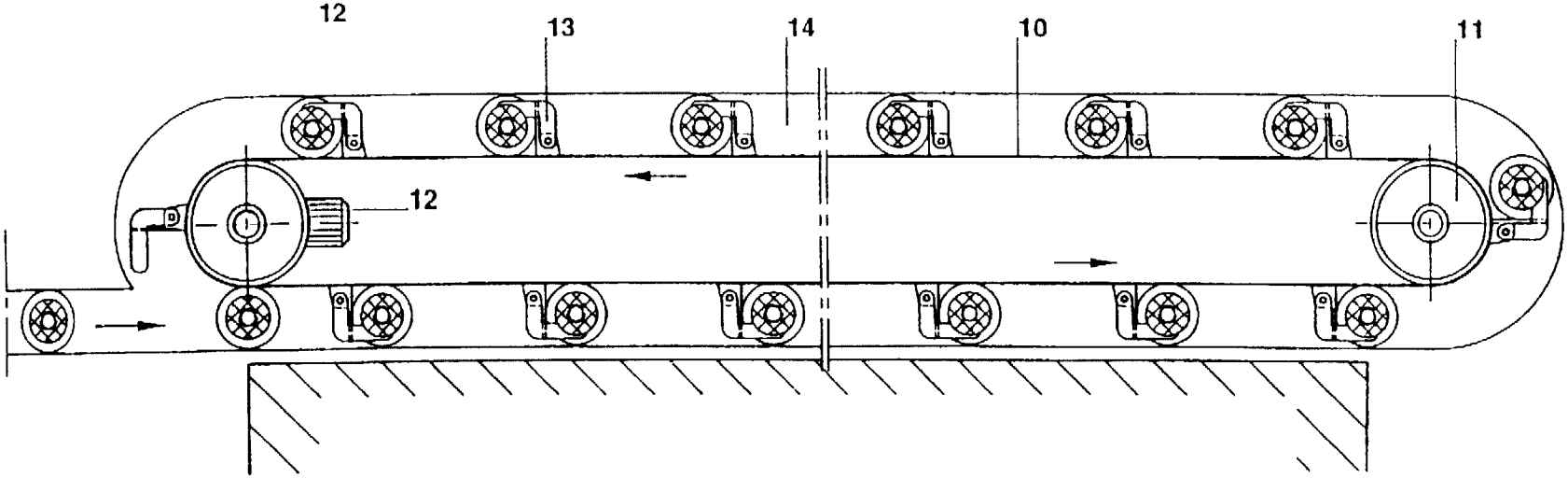
FIG. 2 is a general view of the conveyor system with its drive means. The dashed area represents the coning machine front side, opposite to the conveyor system.

In that way, the spool carrier disks (1) are caused to circulate flanked by the drive means (10), resting and sliding on a support plane (14), owing to the effect of the push applied to them by the bracket (21) and guided by the jutting members (20') and (23) which constrain the spool carrier disks (1) to move on the horizontal plane at a preestablished distance from the belt (10) according to a closed loop trajectory as shown in FIG. 2, in which the dashed region indicates the front side of the coning machine.

Both juttings (20') and (23) also perform a second, essential function, i.e., they keep the spool carrier disks (1) resting on its support plane and, consequently, the spool always is in the vertical position, even in case of unevenness along the path, and changes in speed and running direction.

On the left-hand side of the loop of FIG. 2, a spool carrier disk feeding system is schematically indicated, which feeds full (i.e., cop bearing) spool carrier disks (1) to occupy the free places on the transport system.

Like the lower surface of the base of the spool carrier disks (1), the support surface (14) is advantageously made from such materials, and with a finish degree, as to insure low adhesion for the spool carrier disks resting on it, so that the spool carrier disks (1) slide on it with a very small applied force.

According to the present invention, the base (20) is so shaped and fastened to the belt (10), that the forked juttings (20') and (23) are at a distance from the support plane (14), which is just slightly longer than the thickness of the base (2) of the spool carrier disks (1), and at a mutual transversal distance which is just slightly greater than the diameter of the collar (3).

At each coning station of the coning machine, a diversion path is provided. The path begins with an upstream draft (16) and a downstream extension (16') and a diverting member constituted by a pin or blade (17). The member (17) can be commanded to protrude to act as an obstacle hindering the passage of a spool carrier disk (1), but not the bracket (21), along the support surface (14). The diverting member is commanded by means of a drive means of conventional type not indicated in the figure, following a request sent by the overhanging winding unit for a spool.

Owing to the combined effect of the push applied by the bracket (21), which continues to move rightwards, and of the hindrance constituted by the blade (17) and the extension (16'), the spool carrier disk (1) is pushed towards the coning station, while progressively opening the jutting member (23) of the forked shaped jutting members (20')/(23) by means of the push applied by its collar (3), until the spool carrier disk (1) becomes disengaged from the push applied by the bracket (21) and reaches the stand-by position (A) along the straight path of the spools inside the interior of the winding station.

When the new spool comes to the stand-by position (A), a sensor means, not indicated, signals the event and commands the released diverting blade (17) to return to its resting position.

The rectilinear trajectory for spool processing inside the interior of the coning station is realized with a support plane (18) smoothly radiused to the plane (14), with stationary guides (19) and with pushing means. According to the invention, the guides (19) are arranged to extend over the base (2) of the spool carrier disks (1) and the guides (19) are arranged at a distance from the support plane (18) which is just lightly larger than the thickness of the base (2), and at a mutual transversal distance which is just slightly larger than the diameter of the collar (3).

The so defined processing path contains at least three working positions. A first position, referred to as the "(A) position" is the position reached by the spool as soon as it is delivered by the transport system and waiting to be brought to the unwinding step, which takes place at the second position, i.e., the "(D) position". The unwound spool, which by now no longer contains its cop, or which cannot be further unwound, is brought to the "(S) position" in order to be discharged to the conveyor system designed to handle the exhausted ("empty") spools.

In the schematic view of FIG. 1, for the sake of simplicity, only illustrates one of the plurality of spool paths provided for the displayed winding station. Actually, the upper loop for feeding the ready spools and the bottom loop for discharging the exhausted spools are connected to each other by a plurality of such paths, the number of which is equal to the number of winding units of the machine.

Figures 1, 3A:
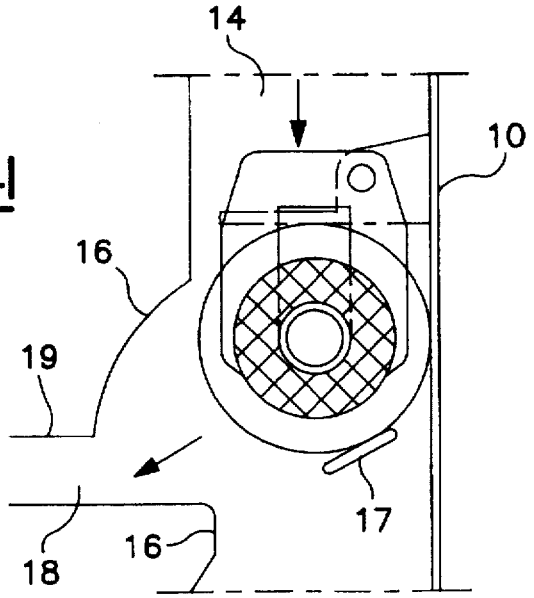
FIG. 3A is a plan view of one embodiment of the feeding components of the system for conveying the spool carrier disks.
Figures 2, 3A:
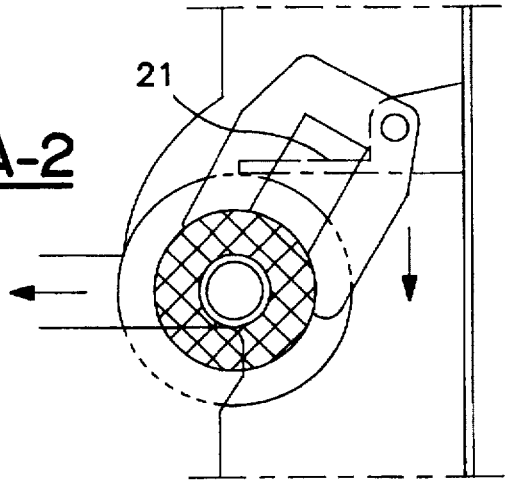
Figures 3, 3A:
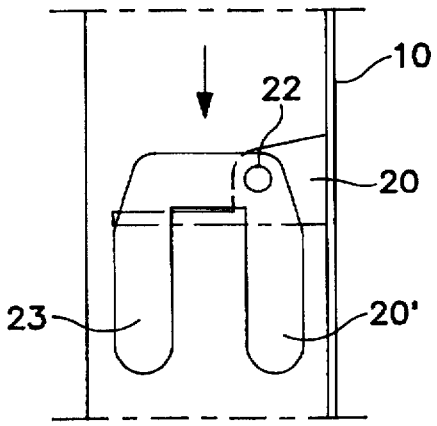

In FIGS. 3A/B, two embodiments of the pushing/guide means (13) are schematically illustrated.

The spools move from top downwards on the plane of the drawing, and three positions in cascade are indicated: the spool meeting the diverting blade (17), the fork opening and delivering the spool to the coning station, and, finally the by now empty pushing/guide means (13) which is being brought away. In FIG. 3A, both juttings (20') and (23) are hinged around hinge (22) and can rotate to open towards the front side of the coning machine, and deliver the spool carrier disk means. In FIG. 3B, the jutting member (20') was not installed, and the task of retraining the spool carrier disk was committed to the belt 10.

Figure 4:
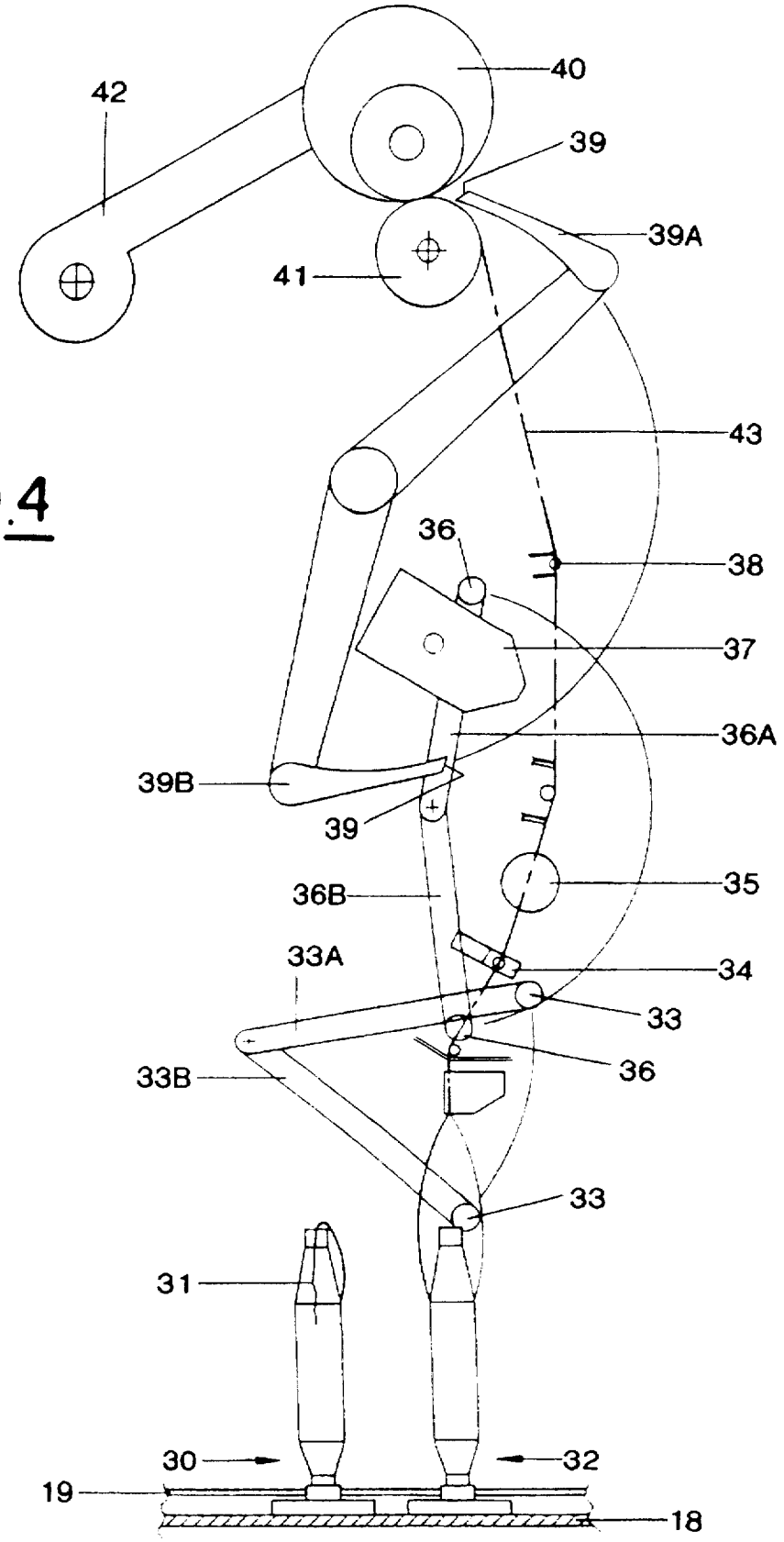
FIG. 4 is a schematic side view of a coning unit and its main components.

In FIG. 4, the coning station is schematically illustrated with its main components.

With the reference numeral (30) a spool in stand-by state is displayed, with its thread end (31) placed inside and top opening of the tube. With (32) the spool which is being unwound is indicated; the reference numeral (33) indicates the suction mouth for the spool thread end, in its position (33A) in which said suction mouth delivers the thread to the suction mouth of the knotting device, and in its position (33B) in which said suction mouth takes the thread end from the spool (32). The sensor for thread presence on the spool is indicated with (34) and the thread tightener is indicated with (35). The reference numeral (36) indicates the thread end suction mouth of the knotting device on the spool side, in its position (36A) in which it delivers the thread end to the knotting device (37), and in its position (36B) in which it takes the thread end from the suction mouth (33). The slub catcher is indicated with (38) and (39) is the suction mouth for the thread end from the cone (40), in its positions (39A) in which it catches the thread end from the cone and (39B) in which it delivers said thread end to the knotting device (37). The cone drive roller is indicated with (41) and the cone carrier arm is indicated with (42). The trajectory (43) of the thread between the spool and the cone is indicated in chain line.

The handling of the spools between (A), (D) and (S) positions is determined by commands sent by the coning station. In those cases when the coning procedure was discontinued owing to lack of thread coming from spool side, the spool which is being unwound (32) is regarded as being exhausted by the components of the coning machine, either because it was completely unwound, or because a certain number of attempts of thread ends search, catching and knotting were unsuccessful: in that case, the coning machine pilot unit commands the change of the spool which is being unwound.

The command of unwound spool change is then integrated by the pilot unit with both the command for calling a new reserve spool from its stand-by position (A), liberated during the spool change, and the command for exhausted spool removal. The call for the new spool is implemented by causing the diverting blade (17) to move upwards. The exhausted spool which is in (S) position must be removed at once in order to provide a free position; the removal must take place on the first signal.

According to the present invention, the motion of the spools inside the interior of the coning station is caused to take place by a push action.

In the embodiment shown in FIG. 1, the spools are caused to move by means of the pair of pushing levers (50) and (51), which pivot around the hinges (52) and (53), and are linked by the tie-rod (54). They are positioned above the guides (19) and are caused to pivot according to a limited revolutionary stoke in clockwise and counterclockwise directions, alternatively, by the double acting hydraulic cylinder (55), e.g., pneumatically actuated with the compressed air the machine is fed with. According to the illustrated embodiment, the levers (50) and (51)—at least as regards the lever (51)—with the far ends pivoting about hinges (52) and (53), respectively, and with their free ends being equipped with articulated joints which remain rigid when the levers engage the collars and urge the spool carrying disks (1) downwards, i.e., toward the discharge path on the plane (18) of FIG. 1 by being caused to revolve counterclockwise. On the other hand—the articulated free ends of the levers (50) and (51) fold on themselves when, during their return movement back to their rest positions, the levers are caused to revolve clockwise and contact the collars of the respective spool carrier disks (1) of the new spool which is being unwound and, possibly, also of the new spool in stand-by position. The articulated joints return back to their extended position after overcoming the obstacles (collars), owing to the action of a spring of conventional type, not shown in the figure.

During their revolutionary movement in the counterclockwise direction, the levers (50) and (51) reach their positions (50') and (51') catching both spools illustrated in FIG. 1 in the positions (A) and (D), respectively, and moving them to the positions (D) and (S), respectively. In the same way as for the spool in (A) position, when the new spool comes to the (D) position a sensor, not shown in the figure, signals the occurred change to the pilot unit which then may command the coning procedure to be started again.

The spool discharged to the (S) position is immediately removed. The system for handling the exhausted spools in FIG. 1 is illustrated with an identical system to the handling system for the spools delivered to the coning station. The exhaust system has a drive means (10'), a support surface (14') and pushing members (13') analogous to the same components as disclosed hereinabove. The system is installed on the front side of the coning machine which is opposite to the side of the handling system designed to handle full spools and is designed to receive the exhausted spools from the plurality of coning stations which constitute the coning machine. The operations of delivery of the exhausted spools to the transport system for exhausted spools is commanded by the machine pilot unit and is conditioned by a sensor (60) of conventional type, e.g., a double-position optical sensor, which signals, with a suitable advance warning, that a bracket (13') without a spool carrier disk means is approaching. The removal takes place by means of a push lever system analogous to the preceding one and has a push lever (61) which pivots around the hinge (62). The push lever is caused to revolve according to a limited revolution stroke in the clockwise and counterclockwise directions, by the double acting cylinder (63). As soon as the spool carrier disk (1) with the exhausted spool is urged to reach the position in which it can be caught by the arriving bracket (13'), the lever (61) is caused to return back to its rest position.

Figure 5:
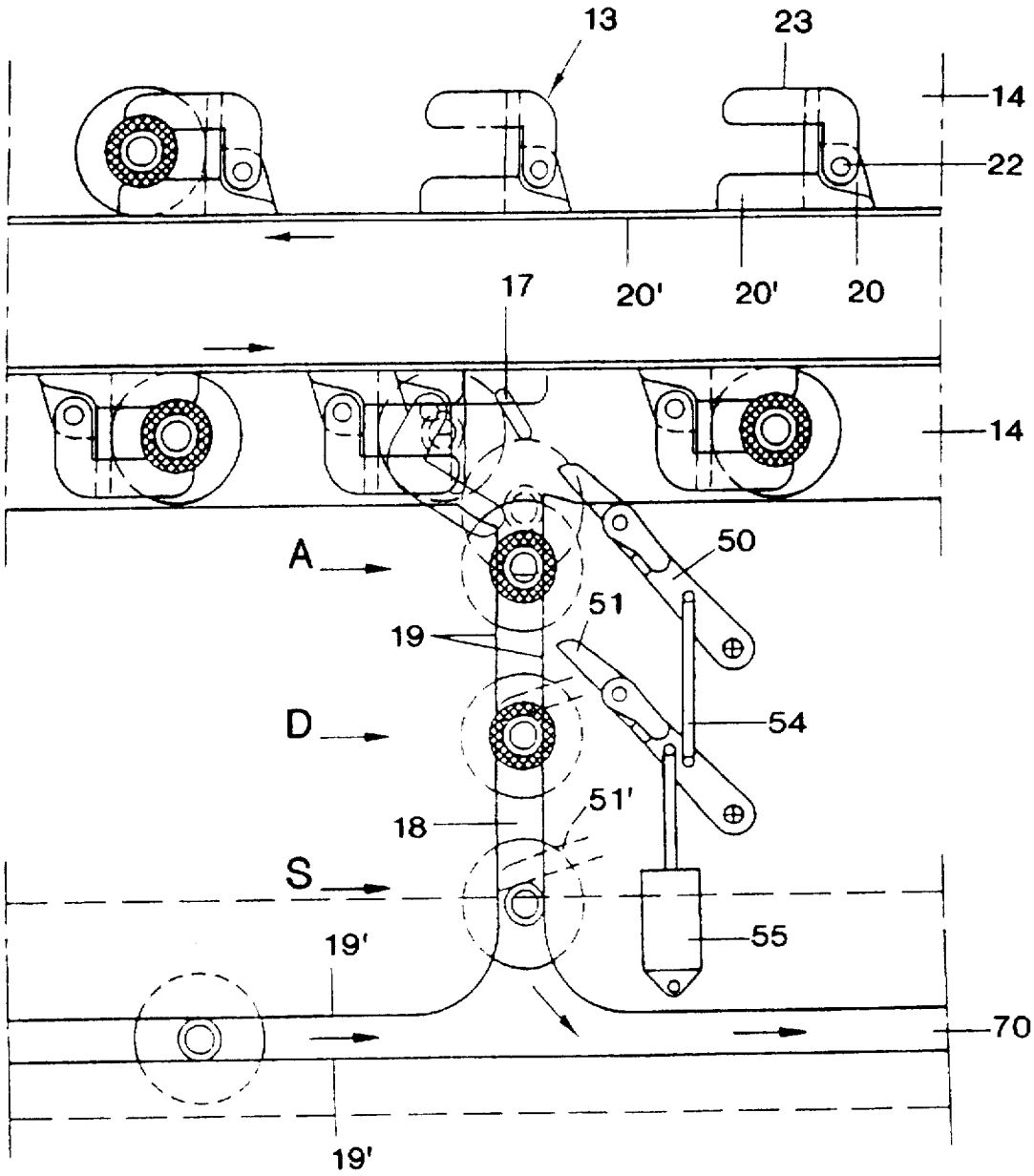
FIG. 5 is a plan view of the conveyor system at a coning station according to another embodiment of the discharge system of the present invention for the exhausted spools.

In FIG. 5, an alternative embodiment of the system for discharging the exhausted spools from the coning machine is shown, which adopts the transport on a conveyor belt installed along the front side of the coning machine to receive the exhausted spools removed from the plurality of coning stations which compose the machine.

As illustrated, a conveyor belt (70) is used, the width of which substantially exceeds the cross sectional size of the spool carrier disk (1). The shift of the lever (51) to its position (51') brings the spool carrier disk (1) with the exhausted spool, at least for a large portion thereof, on the belt (70). In the (S) position, both guides (19') are shaped with a wide taper towards the outlet, with the discharge path for the exhausted spools being smoothly radiused with the guides (19), to obviate the risk of blockage.

The scheme of FIG. 4 also can be realized with a narrower conveyor belt. In this case, the system for discharging the spools onto the conveyor belt uses a supplementary push device, like the lever (61) illustrated in FIG. 1, which pushes the spool carrier disk (1) with the exhausted spool onto the conveyor belt.

The disclosed spool handling system offers considerable advantages over the systems of the prior art. Among them, we regard the following worth mentioning.

The full spool feed loop can be kept continuously moving with all, or most, of its transport positions being full with ready-to-unwind spools, so as to meet very rapidly the request for spools coming from the coning stations, and to have a reserve (magazine) of ready-to-unwind spools for meeting peak requests.

The spools present in the loop are kept at a certain distance from each other, so as to avoid jamming and collisions during the handling. The closed loop is kept moving by means of one single drive system, whilst the conveyor belts of the prior art require that the guide means and the drive means be changed at each change in running direction. The presence of the forks (20')/(23) in the handling system and of the upper guides (19) inside the coning station insures that the spool carrier disks (1) will always remain resting on the support plane and that the spools always will stand in the vertical position, also when running speeds and directions are changed. Therefore, no substantial limits exist for spool handling speeds. The support surfaces (14) and (18) can be provided with suitable openings for removing dirt and impurities developed during the unwinding step.

We claim:

1. In a conveyor system for an automatic coning machine having coning units for unwinding thread from spools carried by disks, wherein the system has a conveyor for feeding the spool carrying disks to the coning machine and passages connected to the conveyor and traversing each adjacent coning unit, the improvement comprising:

a plurality of feeders connected to and movable with the feeding conveyor, wherein said feeders are spaced apart from one another and wherein each of said feeders includes an engaging member for contacting a spool carrying disk and moving the spool carrying disk along the conveyor, and a jutting member movably connected to said feeder which contacts the engaged spool carrier disk for guiding the spool carrier disk in a desired position along the conveyor, and a movable deflector operatively connected to each coning unit and its adjacent passage, wherein said deflector is movable into the path of a spool carrying disk being fed along the feeding conveyor by a feeder for engaging and deflecting the movement of the spool carrying disk from said feeder when a spool carrying disk is required by the coning unit in its adjacent passage, whereupon said movable jutting member of said feeder moves in the direction of the passage for discharging the spool carrying disk from said feeder into the adjacent passage and said deflector is movable out of the path of said feeder, all without interfering with the movement of the feeding conveyor and the other spool carrying disks being moved therealong by said feeders.

2. The conveyor system of claim 1, wherein the spool carrying disks include a base and a collar above the base, wherein said engaging member of a feeder is a bracket extending perpendicularly from the feeding conveyor, and wherein said bracket engages the base of a spool carrier disk.

3. The conveyor system of claim 2, wherein said jutting member is hingedly connected to said feeder and wherein said jutting member engages the collar of the spool carrier disk and maintains the spool carrier disk in a vertical position.

4. The conveyor system of claim 3, wherein each feeder has another member opposing, movable with and extending along with said jutting member which forms a space for slidably engaging the collar of the spool carrying disk therebetween to guide the spool carrying disk along the feeding conveyor and to discharge a spool carrying disk deflected by said deflector from the feeding conveyor into the passage as required by the adjacent coning unit.

5. The conveyor system of claim 1, wherein the system also has a removal conveyor for transporting exhausted spool carrying disks from the coning machine, and wherein each traversing passages interconnects the feeding and removal conveyors at each coning unit, and wherein each of said passages includes a standby position adjacent the feeding conveyor for receiving a spool carrying disk, an unwinding position at the coning unit for unwinding the spool carrying the disk and a discharge position adjacent the removal conveyor for receiving the exhausted spool carrying disk from the unwinding position.

6. The conveyor system of claim 5, wherein the disks of the spool carrying disks have bases and collars which are above and which have a breadth that is less than the breadth of said bases, and wherein each of said passages is rectilinear and includes a surface on which the spool carrier disks are movable, and stationary guides which are above said surface and the bases of said spool carrying disks and which are spaced from one another for engaging opposing portions of the collars for guiding the spool carrier disks along said passage.

7. The conveyor system of claim 6, wherein the downstream guide of a passage, relative to the movement of the feeding conveyor, includes an extension which extends into the path of the feeding conveyor for guiding a deflected spool carrying disk into the passage and the upstream guide of the passage, relative to the movement of the feeding conveyor, includes a draft for facilitating the movement of the deflected spool carrying disk into the passage.

8. The conveyor system, of claim 5, further comprising a pair of spaced apart pivotal levers at each of the passages and the adjacent coning units which have rest positions out of the path of each passage and which are movable into the path of the passage for engaging the spool carrying disks in the standby and unwinding positions, respectively, in response to the unwinding operation at the coning unit and for moving the engaged spool carrying disks from standby and unwinding positions, respectively.

9. The conveyor system of claim 8, wherein said levers are hingedly connected at one end to the system adjacent each passage and include articulated free ends, wherein said levers are movable in one direction from a rest position into the path of the passage for engaging and moving the spool carrying disks while said levers remain rigid, and wherein said articulated free ends of said levers are foldable upon themselves upon engagement with the spool carrying disks in the passage as said levers move in the opposite direction and return to their rest positions.

10. The conveyor system of claim 8, further comprising a device adjacent said discharge position of each of the passages for engaging the exhausted spool carrying disk thereat and for moving the exhausted spool carrying disk onto the removal conveyor.

11. The conveyor system of claim 8, wherein the removal conveyor includes a plurality of receivers, wherein said receivers are spaced apart from one another and wherein each of said receivers includes an engaging member for contacting an exhausted spool carrying disk and moving an exhausted spool carrying disk along the removal conveyor, and a jutting member movably connected to said receiver which engages the exhausted spool carrying disk for guiding the exhausted spool carrying disk along the removal conveyor.

12. The conveyor system of claim 8, wherein the removal conveyor is a conveyor belt which engages and removes exhausted spool carrier disks from the discharge position of the passage and for removal of the exhausted spool carrying disks from the coning machine.

* * * * *